United States Patent [19]

Grzelka et al.

[11] Patent Number: 4,538,938

[45] Date of Patent: Sep. 3, 1985

[54] ADJUSTABLE LOCKING CHOCK SYSTEM

[75] Inventors: Andrew Grzelka; Davis R. Hodges, both of Gautier, Miss.

[73] Assignee: Litton Systems, Inc., Beverly Hills, Calif.

[21] Appl. No.: 498,302

[22] Filed: May 26, 1983

[51] Int. Cl.[3] ..... E02B 17/06

[52] U.S. Cl. ..... 405/198; 254/95

[58] Field of Search ..... 405/196–200; 254/89 R, 95

[56] References Cited

U.S. PATENT DOCUMENTS

| | | | |
|---|---|---|---|
| 3,343,371 | 9/1967 | Heitkamp | 405/198 |
| 4,255,069 | 3/1981 | Yielding | 405/196 |
| 4,269,543 | 5/1981 | Goldman et al. | 405/198 |
| 4,431,343 | 2/1984 | Uchiyama et al. | 405/198 |

*Primary Examiner*—David H. Corbin

[57] ABSTRACT

The chock system has a plurality of teeth that are moveable individually generally parallel with a leg rack of a jack-up rig unit for pre-locking alignment with the rack teeth pitch, and as a group into and out of locking engagement with the leg rack so that accurate and positive engagement can be made by each of the teeth with the mating root between adjacent ones of a plurality of leg rack teeth.

9 Claims, 4 Drawing Figures

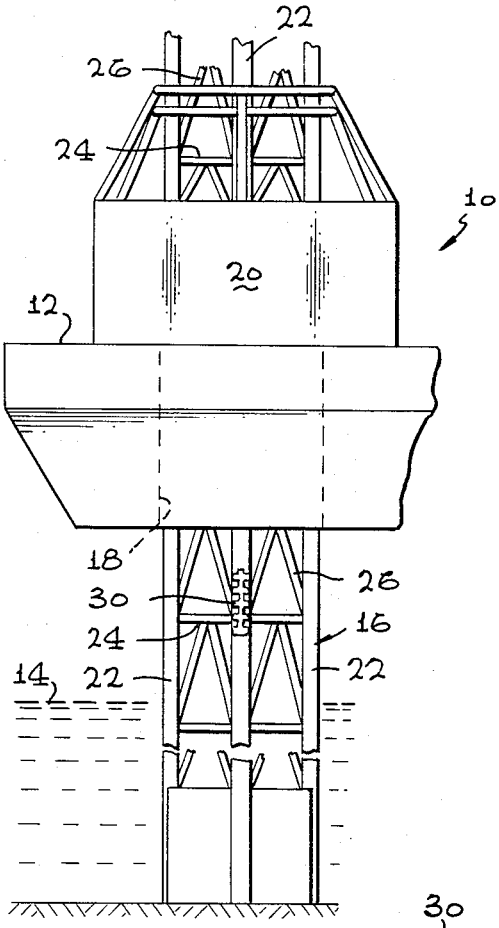
FIG. 1
PRIOR ART
FIG. 3
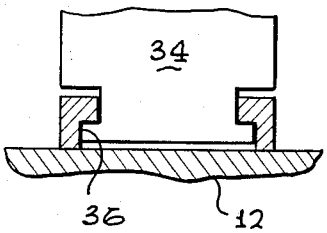
FIG. 2
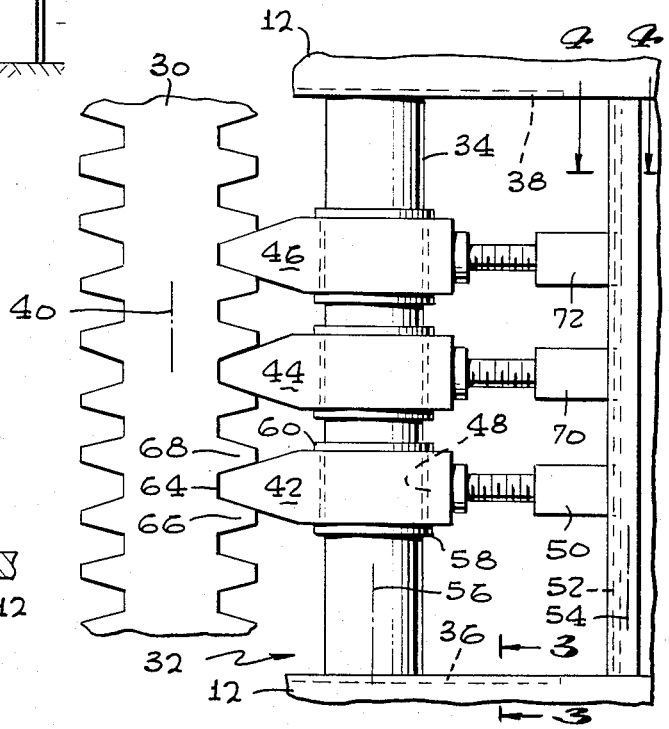
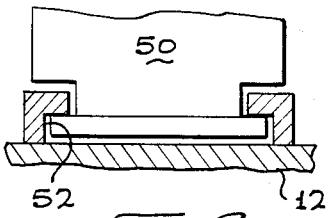
FIG. 4

ADJUSTABLE LOCKING CHOCK SYSTEM

TECHNICAL FIELD

An adjustable locking chock system having individually moveable teeth for pre-locking alignment with a rack of a jacking system for a jack-up rig unit, and movable as a group into locking engagement with the rack.

BACKGROUND ART

A dispositive treatise on jack-up rig units, rack-and-pinion type jacking systems, and rack chocks, including other forms of rack-teeth engaging devices, is available in U.S. Pat. No. 4,269,543 granted May 26, 1981 to J. L. Goldman et al.

The rigidification system of U.S. Pat. No. 4,269,543 includes a three-tooth rack chock element to "interdigitate and mate" with the teeth of the leg rack, yet teaches that the desired rigidification by "one simple tooth is possible." Most leg racks are fabricated by flame cutting which can, and usually does, develop racks that are out-of-tolerance. It is known that available leg racks, because of this imprecise cut, do not have identical tooth profiles and tooth spacing, i.e., pitch. This lack of precision does not affect known jacking systems since the pinion arrangement of such systems accomodates dimensional variations. Such a jacking system (rack-and-pinion type) is taught by U.S. Pat. No. 3,606,251 granted Sept. 20, 1971 to H. L. Willke et al. and reissued Feb. 14, 1978 as U.S. Pat. No. Re 29,539. However, because of these dimensional variations, it can not be assured that load bearing contact between the rack chock and the leg rack is made with more than one tooth since the rack chock cannot be custom fitted to the leg rack when the relative position of the moveable platform can and does vary over the entire length of the leg rack.

In a best mode of the invention, the chock system has a plurality of teeth that are moveable individually generally parallel with a leg rack of a jack-up rig unit for pre-locking alignment with the rack teeth pitch, and as a group into and out of locking engagement with the leg rack so that accurate and positive engagement can be made by each of the teeth with the mating root between adjacent ones of a plurality of leg rack teeth.

BRIEF DESCRIPTION OF THE DRAWINGS

The invention is described in detail below with reference to the drawing that includes an illustration of one specific embodiment, in which:

FIG. 1 is an elevation view, partly broken away, of a PRIOR ART jack-up rig unit wherein the invention can find use.

FIG. 2 is an elevation view, partly broken away and sectional, of one specific embodiment of the invention.

FIG. 3 is a view of the specific embodiment of FIG. 2 along the line 3—3.

FIG. 4 is a view of the specific embodiment of FIG. 2 along the line 4—4.

BEST MODE OF CARRYING OUT THE INVENTION

An example of one PRIOR ART form of jack-up rig unit 10 is shown by FIG. 1. The rig unit 10 has a working platform 12, which can also function as a vessel hull when it is in physical contact with water 14; for example, when it is floated in the water and moved to a working location. The rig unit 10 has one or more upright leg structures, such as leg structure 16, that extend through a platform opening which is indicated generally at 18 in phantom. A jack house 20 is mounted on the platform 12 above each such leg opening 18. The jack house 20 extends upwardly from the platform and generally encloses the associated leg structure 16.

The leg structure 16 is illustrated as a trussed type formed with three or more chords. Three identical tubular column members 22 are arranged in a triangular relationship with each column member positioned at one apex of the triangle, and interconnected by horizontal brace members 24 and diagonal, but generally longitudinally extending, brace members 26.

A rack member 30, which can be a dual rack as illustrated by FIGS. 1 and 2, is provided on each of the column members 22 and extends longitudinally along the column member. The rack member 30 is engaged by the jack pinions of a jack (not shown) to move the working platform 12 relative to the leg structure 16; usually to either raise or lower the platform relative to the water surface 14.

When the working platform 12 is at its desired position, the adjustable locking chock system 32 of the invention is shown by FIG. 2 is moved into engagement with the associated rack member 30 and the platform is locked to the legs 16. This is required for safety.

The adjustable locking chock system 32, as shown by FIGS. 2–4, has a support member 34 that has an external thread. The support member is positioned and retained between guide tracks 36 and 38 which are carried by the platform 12. The support member 34 is moveable along the guide tracks 36 and 38 in a lateral direction relative to the longitudinal axis 40 defined by the leg rack 30. A plurality of similar teeth, 42, 44 and 46, are carried by and moveable with the support member 34. Although three teeth are illustrated by FIG. 2, any number of teeth can be used; however, it is preferred that more than one tooth be used. The number of teeth will vary according to the load carrying requirements placed on the locking system 32.

Each tooth 42, 44 and 46 is structurally identical to the other teeth so only the structure of tooth 42 will be described for clarity and simplification of description.

Tooth 42 of FIG. 2 has a clear bore 48 that receives the support member 34. The clear bore 48 has an internal diameter that is greater than that threaded outer diameter of the support member so that the tooth 42 can be readily moved along the support member 34. A screw jack 50 acts upon the tooth 42 and is moveable with the tooth. Screw jack 50 is positioned and retained by a guide track 52 that is more clearly shown by FIG. 4. Guide track 52 defines a longitudinal axis 54 that is generally parallel with a longitudinal axis 56 as defined by the support member 34. It is contemplated that other jack means can be used. A pair of threaded locknuts 58 and 60 fix the position of the tooth 42 relative to the support member 34, and to the leg rack 30, when each locknut is screwed down hard onto the tooth.

Pre-locking alignment of any one or all of the teeth 42, 44 and 46 is made by loosening the respective locknuts, for example, locknuts 58 and 60 associated with tooth 42, and positioning the tooth relative to a selected root portion 64 of leg rack 30 between adjacent rack teeth 66 and 68. After this pre-locking alignment is completed, the respective pair of locknuts for the associated tooth are screwed down hard onto the tooth to fix it in position on the support member 34 and relative to the selected tooth portion of the leg rack.

The next step in locking the chock system 32 of the invention to the leg rack 30 is the actuation of the screw jack associated with a particular tooth, for example, screw jack 50 and tooth 42, to move the tooth into locking engagement with the leg rack. As the respective screw jacks 50, 70 and 72 are actuated to move associated ones of the teeth 42, 44 and 46, the support member 34 moves along the guide tracks 36 and 38 until the teeth are all set in locking engagement with the leg 30. It is understood that the teeth must be moved out of the locking engagement with the rack before relative movement can commence between the support leg 16 and working platform 12.

When the relative position of the platform to the support leg 16 and its rack 30 results in the longitudinal axis 40 of the rack being out of parallel alignment with the longitudinal axis 56 of the support member 34, the adjustable teeth 42, 44 and 46 can be moved individually by the respective screw jacks 50, 70 and 72 to compensate for this non parallel alignment, and ensure a positive locking engagement.

As will be evidenced from the foregoing description, certain aspects of the invention are not limited to the particular details of construction as illustrated and it is contemplated that other modifications and applications will occur to those skilled in the art. It is, therefore, intended that the appended claims shall cover such modifications and applications that do not depart from the true spirit and scope of the invention.

We claim:

1. A rack chock for a longitudinally extending rack comprising:

(a) a plurality of rack chock teeth movable individually and as a unit, (b) each of said rack teeth having a clear bore, (c) a support column positioned in a generally parallel relationship with the rack, (d) an external thread on said support column, (e) said clear bore of a rack chock tooth accepting said support column therethrough, (f) at least one threaded locknut engaging said support column and rotatable thereon to position said rack chock tooth in general alignment with a rack tooth profile of the rack in an interdigitated but spaced apart relationship with the rack, (g) jack means to position said generally aligned rack chock tooth into and away from an interdigitated contact and rigid locking engagement with said rack tooth profile (h) first guide means for said support column during movement of said plurality of rack chock teeth as a unit and of an individual rack chock tooth, and (i) second guide means for said jack means during movement of said support column and jack means in said positioning of a selected rack chock tooth in said general alignment and in said interdigitated contact and rigid locking engagement.

2. The rack chock of claim 12 in which said support column is longitudinally extending and generally parallel with the longitudinally extending rack.

3. The rack chock of claim 2 in which said first guide means constrains movement of said support column to a generally lateral direction relative to the longitudinally extending rack.

4. The rack chock of claim 3 in which said lateral direction is perpendicular to the longitudinally extending rack.

5. The rack chock of claim 1 in which a pair of threaded locknuts engage said support column with said rack chock tooth in juxtaposition therebetween.

6. The rack chock of claim 2 in which said jack means is a jack unit.

7. The rack chock of claim 6 in which said second guide means constrains movement of said jack unit to a generally parallel direction relative to the longitudinally extending support column.

8. In a structure having a first structural member supporting a longitudinally extending rack, and a second structural member supporting a rack chock for rigidly locking the first structural member to the second structural member, the rack chock comprising:

(a) a plurality of rack chock teeth movable individually and as a unit relative to the rack, (b) each of said rack chock teeth having a clear bore, (c) a support column positioned in a generally parallel relationship with the rack, (d) an external thread on said support column, (e) said clear bore of a rack chock tooth accepting said support column therethrough, (f) at least one threaded locknut engaging said support column and rotatable thereon to position said rack chock tooth in general alignment with a rack tooth profile of the rack in an interdigitated but spaced apart relationship with the rack, (g) jack means to position said generally aligned rack chock tooth into and away from an interdigitated contact and locking engagement with said rack tooth profile, (h) first guide means for said support column during movement of said plurality of rack chock teeth as a unit and of an individual rack chock tooth, and (i) second guide means for said jack means during movement of said support column and jack means in said positioning of a selected rack chock tooth in said general alignment and in said interdigitated contact and rigid locking engagement.

9. In a jack-up unit having a support leg (16) and with a rack (30) connected thereto and disposed generally along a portion of the leg, a platform (12) supported by the leg, and a chock system (32) carried by the platform to selectively lock the leg and the platform together for rigidification of the jack-up unit, a chock system improvement for the jack-up unit characterized by:

(a) a plurality of rack chock teeth (42, 44, 46) movable individually and as a unit relative to the rack, (b) each of said rack chock teeth having a clear bore (48), (c) a support column (34) positioned in a generally parallel relationship with the rack, (d) an external thread on said support column, (e) said clear bore of a rack chock tooth accepting said support column therethrough, (f) at least one threaded locknut (58, 60) engaging said support column and rotatable thereon to position said rack chock tooth in general alignment with a rack tooth profile (64, 66, 68) of the rack in an interdigitated but spaced apart relationship with the rack, (g) jack means (50, 70, 72) to position said generally aligned rack chock tooth into and away from an interdigitated contact and rigid locking engagement with said rack tooth profile, (h) first guide means (36, 38) for said support column during movement of said plurality of rack chock teeth as a unit and of an individual rack chock tooth, and (i) second guide means (52) for said jack means during movement of said support column and jack means in said positioning of a selected rack chock tooth in said general alignment and in said interdigitated contact and rigid locking engagement.

* * * * *